US012643725B2

(12) United States Patent
Rustad et al.

(10) Patent No.: US 12,643,725 B2
(45) Date of Patent: Jun. 2, 2026

(54) CONTAINER CARRIER

(71) Applicant: ILLINOIS TOOL WORKS INC., Glenview, IL (US)

(72) Inventors: Griffin E. Rustad, Chicago, IL (US); Christopher J. Samaras, Tinley Park, IL (US); Hyunchul Kim, Chicago, IL (US); Jacob M. Fornof, Chicago, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 18 days.

(21) Appl. No.: 18/205,245

(22) Filed: Jun. 2, 2023

(65) Prior Publication Data

US 2023/0391525 A1 Dec. 7, 2023

Related U.S. Application Data

(60) Provisional application No. 63/348,615, filed on Jun. 3, 2022.

(51) Int. Cl.
*B65D 71/50* (2006.01)
*B65B 17/02* (2006.01)

(52) U.S. Cl.
CPC ..... *B65D 71/504* (2013.01); *B65B 17/025* (2013.01)

(58) Field of Classification Search
CPC .... B65B 17/025; B65D 71/504; B65D 71/50; B65D 71/502; B65D 2571/002
USPC ..... 206/139, 140, 143, 145, 147, 148, 151, 206/159, 201, 202, 203, 154, 149; 294/87.2
See application file for complete search history.

(56) References Cited

U.S. PATENT DOCUMENTS 5,306,060 A * 4/1994 Borg ..... B65D 71/50 206/199
5,535,879 A * 7/1996 Appleton ..... B65D 71/504 294/87.2
5,735,562 A * 4/1998 Borg ..... B65D 71/50 294/87.2
6,129,397 A * 10/2000 Borg ..... B65D 71/50 206/161
6,394,517 B1 5/2002 Borg
6,715,810 B2 4/2004 Borg
(Continued)

FOREIGN PATENT DOCUMENTS

DE 10 2018 005 250 A1 1/2020
FR 1 221 954 A 6/1960
WO WO 95/08488 A1 3/1995

OTHER PUBLICATIONS

ISA/EP, English language verison of the International Search Report, Form PCT/ISA/210, for International Application PCT/US2023/024405, Sep. 20, 2023 (6 pages).
(Continued)

*Primary Examiner* — Rafael A Ortiz
(74) *Attorney, Agent, or Firm* — Pauley Erickson & Swanson

(57) ABSTRACT

A container carrier for unitizing a plurality of containers includes a network of molded ribs forming a plurality of container receiving openings formed in a first plane and a plurality of teeth formed in the first plane and extending toward a center of each container receiving opening. A rail may be positioned on an underside of the container carrier between each pair of container receiving openings.

8 Claims, 5 Drawing Sheets

(56) References Cited

U.S. PATENT DOCUMENTS

| | | | | |
|---|---|---|---|---|
| 7,108,128 | B2 | 9/2006 | Borg | |
| 7,147,100 | B1 | 12/2006 | Borg | |
| 7,377,382 | B2 | 5/2008 | Borg et al. | |
| 7,588,275 | B2 | 9/2009 | Borg | |
| 7,823,943 | B2 | 11/2010 | Borg | |
| D721,598 | S | 1/2015 | Borg | |
| D722,891 | S | 2/2015 | Borg et al. | |
| D757,548 | S | 5/2016 | Borg et al. | |
| 9,517,859 | B2 | 12/2016 | Borg et al. | |
| 10,266,326 | B2 | 4/2019 | Borg et al. | |
| 10,293,998 | B2 | 5/2019 | Borg et al. | |
| 10,364,080 | B2 | 7/2019 | Tetreault et al. | |
| 10,399,742 | B2 | 9/2019 | Borg et al. | |
| 10,457,445 | B2 | 10/2019 | Borg et al. | |
| 10,892,283 | B2 | 1/2021 | Zhang et al. | |
| 11,001,428 | B2 | 5/2021 | Borg et al. | |
| 11,111,063 | B2 | 9/2021 | Borg et al. | |
| 11,124,341 | B2 * | 9/2021 | Patton | B65D 71/504 |
| 2007/0296231 | A1 * | 12/2007 | Borg | B65D 71/50<br>294/87.2 |
| 2013/0068635 | A1 * | 3/2013 | Ralph | B65D 25/22<br>206/139 |
| 2021/0331849 | A1 * | 10/2021 | Borg | B65D 71/504 |

OTHER PUBLICATIONS

ISA/EP, Form PCT/ISA/237, Written Opinion of the International Searching Authority, for International Application PCT/US2023/024405, Sep. 20, 2023 (5 pages).

* cited by examiner

CONTAINER CARRIER

CROSS-REFERENCE TO RELATED APPLICATIONS

This application claims priority to U.S. Provisional Application, Ser. No. 63/348,615, filed on 3 Jun. 2023. This U.S. Provisional Application is hereby incorporated by reference herein in its entirety and are made a part hereof, including but not limited to those portions which specifically appear hereinafter.

BACKGROUND OF THE INVENTION

Field of the Invention

This invention relates generally to beverage multipacks and, more particularly, to multipacks made up of a plurality of containers.

Description of Prior Art

Conventional container carriers are often used to unitize a plurality of similarly sized containers, such as cans, bottles, jars and boxes and/or similar containers that require unitization. Flexible plastic ring carriers and paperboard boxes are two such conventional container carriers.

However, with growing concerns surrounding the environmental impact of improper disposal of plastic waste, manufacturers are transitioning offerings to best support a circular economy. One such solution is plastic ring carriers made from 50% post-consumer recycled content. This carrier is operationally efficient, competitively priced, simple, and has a low carbon footprint in comparison to other beverage multipack alternatives. Today, this flexible solution is not considered 100% curbside recyclable by the FTC Green Guide because 60%+ consumers cannot recycle flexible plastics.

Multi-packaging systems are generally used in the beer, soft drink, and general products industries. A new and innovative beverage multipacking solution is desirable that includes a 4, 6, 8, and/or 12 beverage capacity. A preferred design is produced using 100% curbside recyclable rigid plastics, like HDPE or PET. These carriers would be applied on PET bottles and/or aluminum cans.

SUMMARY OF THE INVENTION

The invention generally relates to a container carrier for unitizing a plurality of containers into a multipack.

A preferred embodiment of the subject invention is made from materials that are 100% curbside recyclable, in particular rigid PET and HDPE plastics that can enter most municipal recycling streams. This invention focuses on end-user needs and structural plastics that can easily be recycled. A solution that is meaningful, practical and makes a positive impact to encourage people to recycle is desired.

Other objects and advantages will be apparent to those skilled in the art from the following detailed description taken in conjunction with the appended claims and drawings.

DETAILED DESCRIPTION OF THE INVENTION

Figure 1:
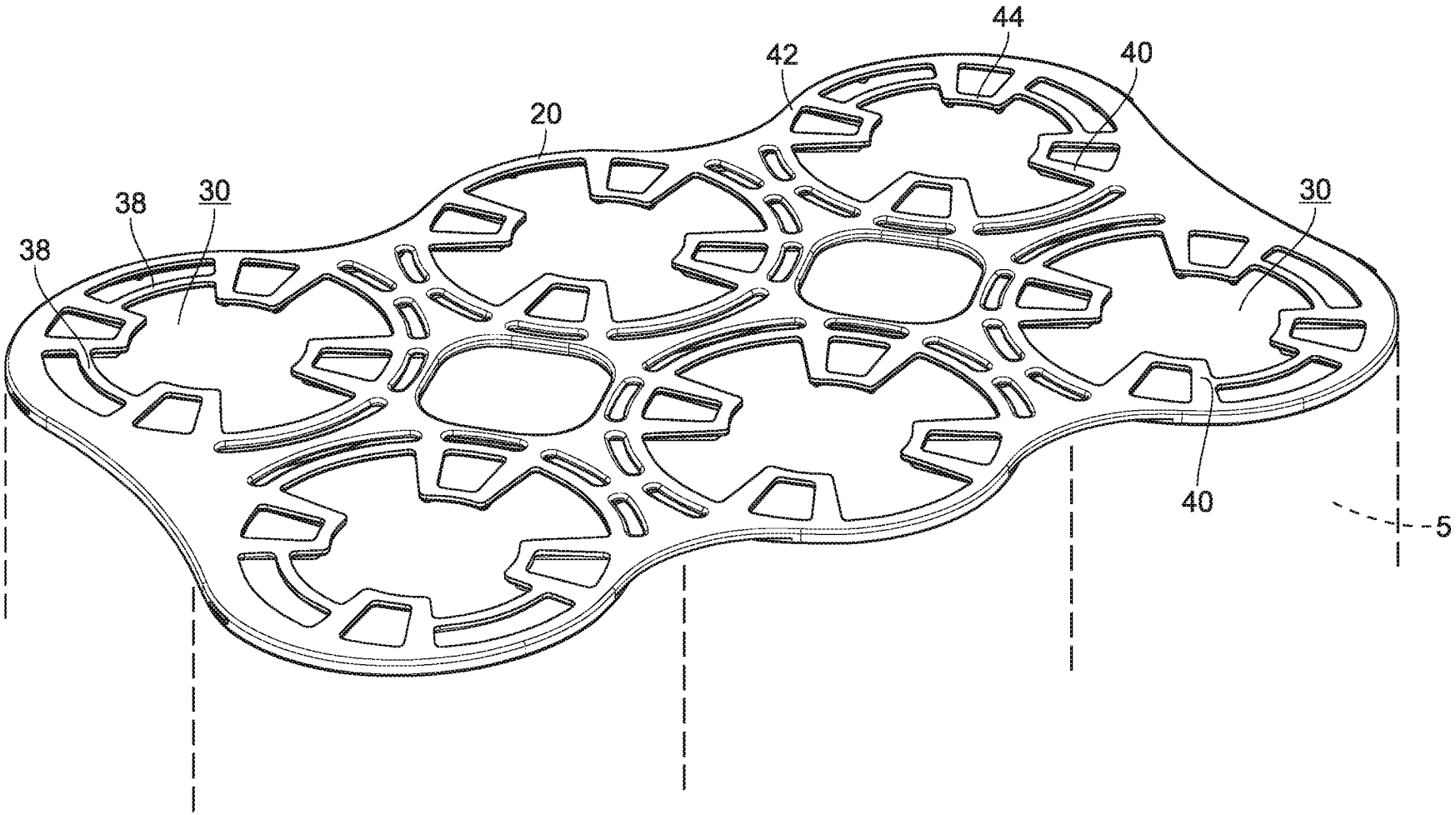
FIG. 1 shows a perspective view of a container carrier according to one embodiment of the invention.

The present invention provides a container carrier to unitize a plurality of containers into beverage multipacks. The container carrier according to this invention is shown in FIGS. 1-6. FIGS. 1 and 5 include phantom lines showing where containers 5 would be positioned within a unitized multipack.

According to a preferred embodiment of this invention, the container carrier 10 is injection molded or otherwise formed from high density polyethylene (HDPE). Alternatively, PET or HDPE plastics may be used. Preferably, the material is generally rigid and 100% post-consumer recyclable in most or all markets.

Once manufactured, the container carrier 10 may be applied to groups of containers 5 to make completed unitized multipacks. Although much of the disclosure shows and describes six pack multipacks, it is further contemplated that 4 packs, 8 packs, 10 packs and 12 packs may be unitized without departing from the essential features of this invention.

In a preferred embodiment of this invention, the container carrier 10 includes a network of molded ribs 20 forming a plurality of container receiving openings 30 corresponding with a desired size of multipack. As such, although FIGS. 1-5 show six container receiving openings in a 2×3 array, other desired container carriers may be 2×2 for a four pack, 2×4 for an eight pack, or other desired arrays forming a desirable quantity multipack size.

The plurality of container receiving openings 30 are preferably formed in a first plane 35. Although the container carrier 10 described includes some thickness, the thickness is generally negligible compared to a footprint of the container carrier 10, particularly in the embodiment shown in FIGS. 1-4. FIG. 5 shows one embodiment of the container carrier 10 having a greater thickness to accommodate heavier or bulkier containers and/or to enable a sturdier unitization of containers.

The container receiving openings 30 are each preferably generally circular but include a plurality of teeth 40 formed in the first plane 35 and extending inwardly toward a center of each container receiving opening 30. The container receiving openings 30 and the respective integrated teeth 40 are preferably all formed in a single, first plane 35. As shown in the figures, each tooth 40 of the plurality of teeth comprises a generally trapezoidal shape having a base 42 that follows the contour of a respective container receiving opening and a slightly curved leading edge 44 that engages with a container.

According to one embodiment, a strut 38 is positioned between teeth 40 in outer container receiving openings 30, i.e., and preferably not in central container receiving openings 30. As shown in the figures, a pair of struts 38 may be positioned within each container receiving openings in the outer pairs, wherein each strut 38 of the pair of struts 38 extends between two teeth 40 of the plurality of teeth.

As shown and described, each tooth 40 of the plurality of teeth 40 is generally trapezoidal having a pair of legs 46 extending from the container receiving opening and each leg includes a lower support rib 48. The teeth 40 are preferably formed equidistantly around a perimeter of each container receiving opening 30. As such, the container receiving opening 30 comprises one diameter while the plurality of teeth 40 together comprise a slightly smaller diameter thereby permitting engagement with a chime or neck of a container 5, preferably a traditional PET plastic or glass bottle. In this manner, a container may be snapped into place within the respective container receiving aperture 30 such that the teeth 40 engage directly with the neck while the remainder of the container receiving aperture 30 simply encircles the neck.

Figure 2:
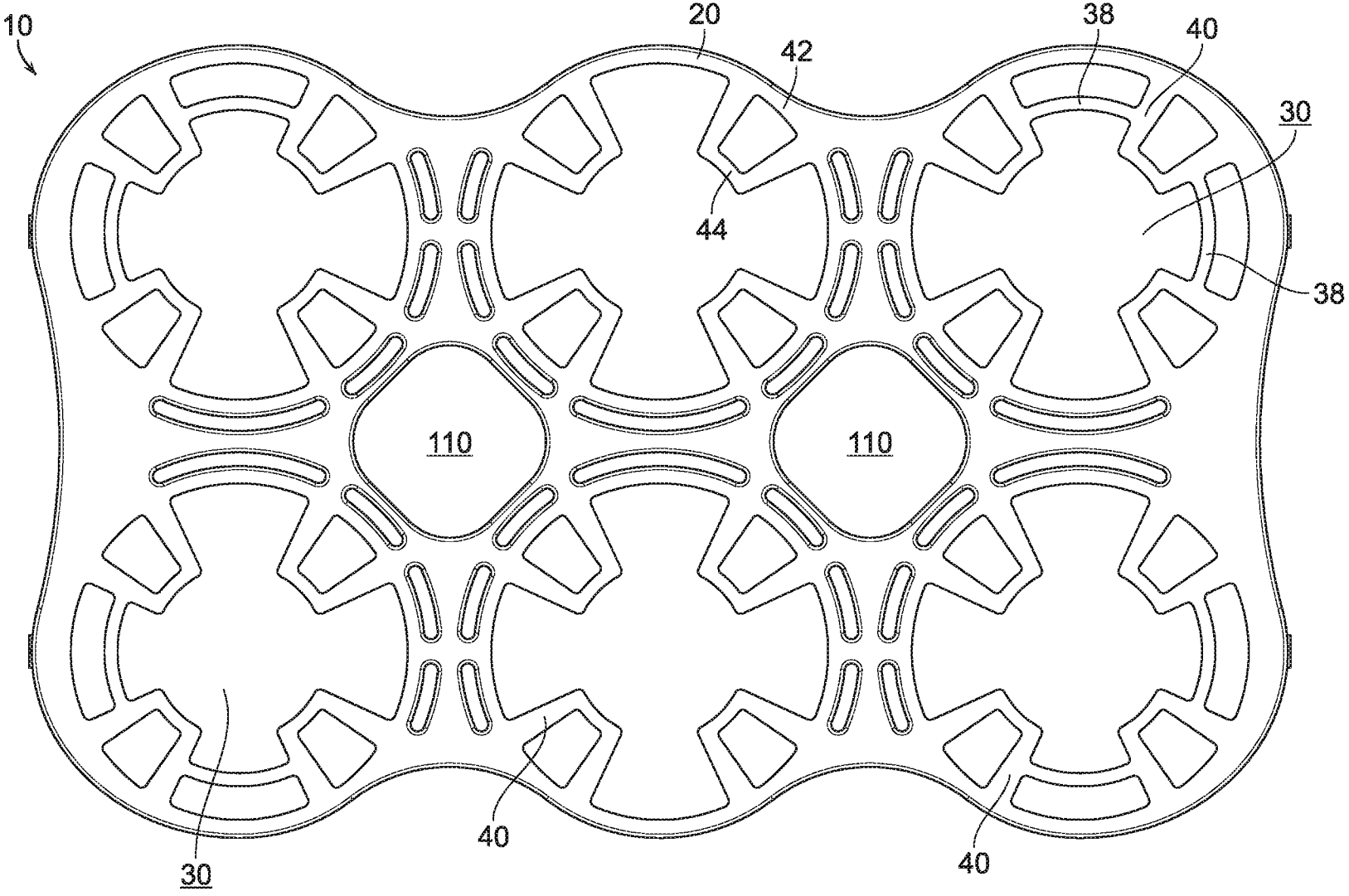
FIG. 2 shows a top plan view of a container carrier according to one embodiment of the invention.

The teeth 40 may be formed equidistantly around the perimeter of each container receiving opening 30, such as shown in FIG. 2. Further, the teeth 40 are preferably offset from longitudinal and transverse axes of the container carrier 10. As such, the teeth 40 in one embodiment are generally positioned at 2, 4, 8, and 10 o'clock presuming 12 o'clock is a top of FIG. 2.

Figure 3:
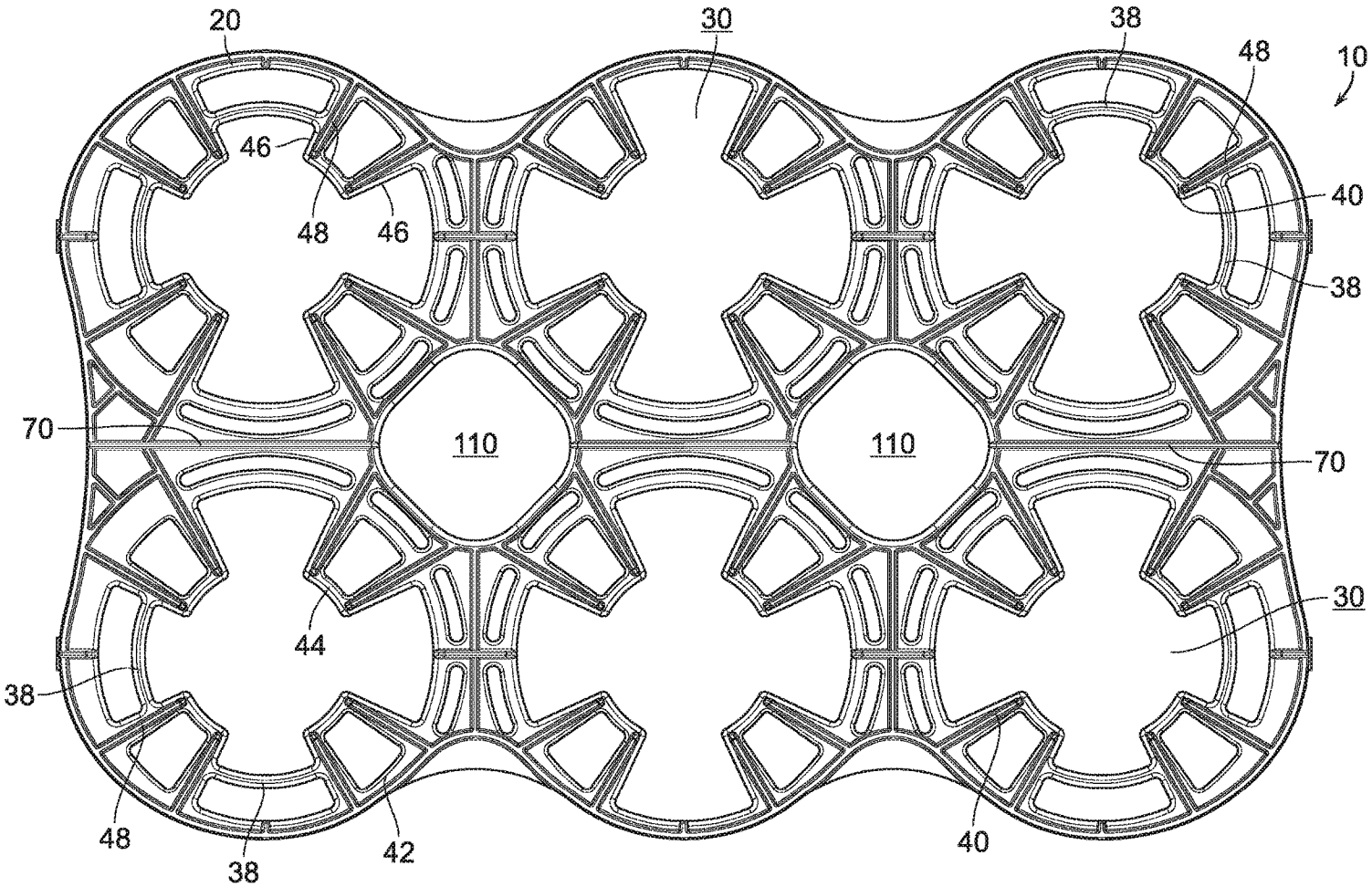
FIG. 3 shows a bottom plan view of a container carrier according to one embodiment of the invention.
Figure 4:
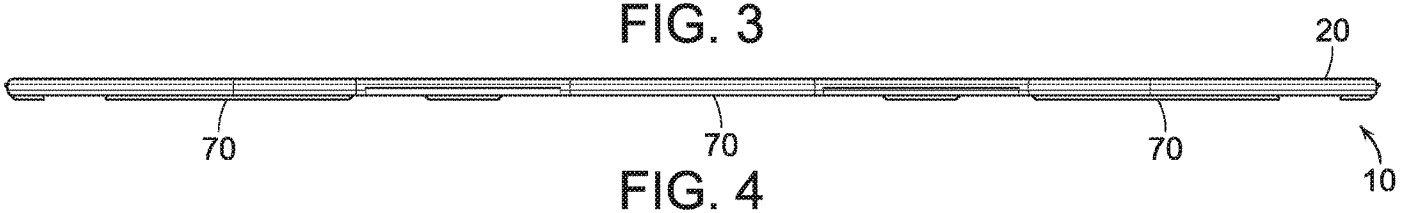
FIG. 4 shows a side view of a container carrier according to one embodiment of the invention.
Figure 5:
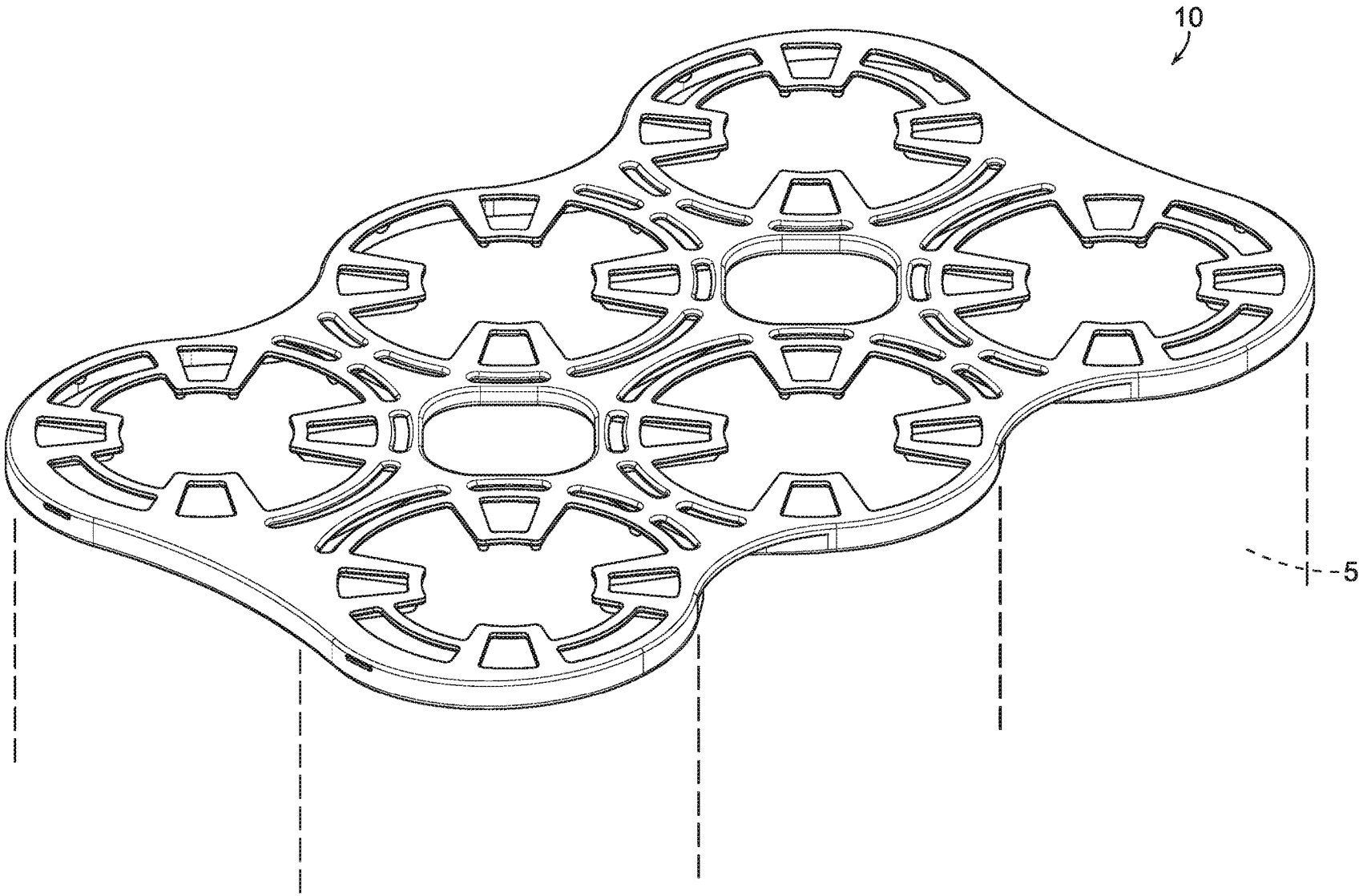
FIG. 5 shows a perspective view of a container carrier according to one embodiment of the invention.

As best shown in FIGS. 3 and 4, the container carrier 10 may further include a rail 70 positioned on an underside of the container carrier 10 between each transverse pair of container receiving openings 30. The rail 70 is preferably fairly narrow and includes a smooth profile that extends downwardly from the first plane 35. In this manner, the container carriers 10 may be stackable but also are easily and smoothly disengageable from the stack for application to containers and handling.

Figure 6:
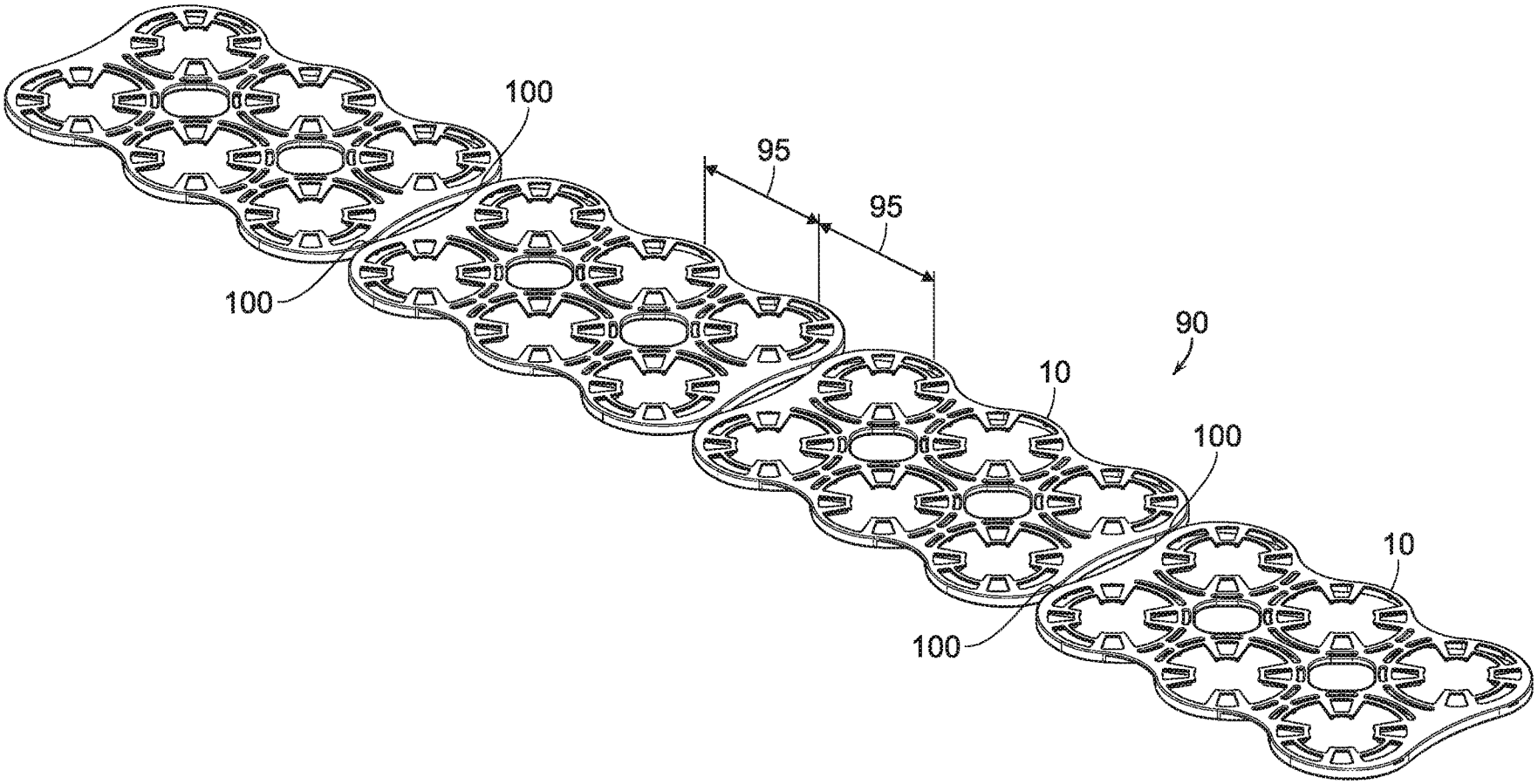
FIG. 6 shows a stick of multiple container carriers according to one embodiment of the invention.

As shown in FIG. 6, the container carrier 10 may be grouped in segments or "sticks" 90 of two to four container carriers 10 connected in a unitized stick 90 that includes frangible connection points 100 between adjacent container carriers 10. For ease of application to containers and handling of bulk container carriers 10, a pitch 95, or longitudinal distance, between adjacent container receiving openings 30 is constant throughout the stick 90. As such, the pitch 95 between container receiving openings 30 within a single container carrier 10 is the same as the pitch 95 between edge container receiving openings 30 that are joined at connection points 100 within the stick 90.

A finger hold 110 is preferably formed between each four of the container receiving openings 30 to provide an opening for grasping the multipack. As such, in a six pack arrangement, a pair of finger holds 110 are formed between six container receiving openings 30. As shown in the figures, these finger holds may be rhombus shaped having generally rounded corners.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A container carrier for unitizing a plurality of containers, the container carrier comprising:

a network of molded ribs forming a plurality of container receiving openings formed in a first plane;

a plurality of teeth formed in the first plane and extending inwardly toward a center of each container receiving opening;

a strut positioned between teeth in outer container receiving openings; and a rail positioned on an underside of the container carrier and extending linearly between each pair of container receiving openings arranged in multiple pairs, the rail having a narrow smooth profile and extending downwardly from the first plane;

wherein two to four container carriers are connected in a unitized stick that includes frangible connection points between adjacent container carriers.

2. The container carrier of claim 1 wherein each tooth of the plurality of teeth comprises a generally trapezoidal shape having a base that follows the contour of a respective container receiving opening and a slightly curved leading edge that engages with a container.

3. The container carrier of claim 1 further comprising a pair of struts, each strut of the pair extending between two teeth of the plurality of teeth.

4. The container carrier of claim 1 wherein each tooth of the plurality of teeth is generally trapezoidal having a pair of legs extending from the container receiving opening and each leg includes a lower support rib.

5. The container carrier of claim 1 wherein the teeth are formed equidistantly around a perimeter of each container receiving opening.

6. The container carrier of claim 5 wherein the teeth are offset from longitudinal and transverse axes of the container carrier.

7. The container carrier of claim 1 wherein a pitch between adjacent container receiving openings is constant throughout the stick.

8. A multipack including a container carrier and a plurality of unitized containers, the multipack comprising:

a plurality of containers;

a network of molded ribs forming a plurality of container receiving openings formed in a first plane, the plurality of containers each positioned within a respective container receiving opening;

a plurality of teeth formed in the first plane and extending inwardly toward a center of each container receiving opening;

a strut positioned between teeth in outer container receiving openings; and a rail positioned on an underside of the container carrier and extending linearly between each pair of container receiving openings arranged in multiple pairs, the rail having a narrow smooth profile and extending downwardly from the first plane dividing the containers linearly into two longitudinal rows;

wherein two to four container carriers are connected in a unitized stick that includes frangible connection points between adjacent container carriers.

* * * * *